US005133980A

United States Patent [19]

Ream et al.

[11] Patent Number: 5,133,980

[45] Date of Patent: Jul. 28, 1992

[54] ROLLED TAPE-LIKE CONFECTIONERY PRODUCT IN A DISPENSER

[75] Inventors: Ronald L. Ream, Plano; Ralph R. Burin, Glen Ellyn, both of Ill.

[73] Assignee: Wm. Wrigley Jr. Company, Chicago, Ill.

[21] Appl. No.: 597,075

[22] Filed: Oct. 15, 1990

[51] Int. Cl.[5] ..... B65D 85/671

[52] U.S. Cl. ..... 426/115; 426/5; 225/43; 225/52; 83/649; 206/409

[58] Field of Search ..... 426/115, 5; 225/43, 225/39, 47, 52; 206/409, 411; 83/649

[56] References Cited

U.S. PATENT DOCUMENTS

| | | | |
|---|---|---|---|
| 1,026,778 | 5/1912 | Toles . | |
| 1,829,577 | 10/1931 | Anderson | 225/47 |
| 2,253,744 | 8/1941 | Witt | 225/47 |
| 2,262,260 | 11/1941 | Smith . | |
| 2,276,414 | 3/1942 | Morehouse et al. | 225/52 |
| 2,351,781 | 6/1944 | Punte . | |
| 2,447,519 | 8/1948 | Marinsky . | |
| 2,587,394 | 2/1952 | Shallenberger . | |
| 2,678,777 | 5/1954 | Donkin | 225/47 |
| 2,681,186 | 6/1954 | Slawik | 225/47 |
| 2,710,152 | 6/1955 | Jones | 225/47 |
| 2,750,029 | 6/1956 | Morgan | 225/47 |
| 2,776,095 | 1/1957 | Emmert | 225/47 |
| 2,781,094 | 2/1957 | Martin . | |
| 2,790,609 | 4/1957 | Hawthorn et al. | 225/47 |
| 2,814,383 | 11/1957 | Emmert . | |
| 2,820,631 | 1/1958 | Santos | 225/47 |
| 2,864,446 | 12/1958 | Olson et al. . | |
| 2,889,975 | 6/1959 | Hanlon | 225/47 |
| 3,150,807 | 9/1964 | Loughary | 225/47 |
| 3,791,601 | 2/1974 | Broden | 225/47 |
| 3,972,458 | 8/1976 | Hamada | 225/52 |
| 4,088,276 | 5/1978 | Littleton . | |
| 4,170,914 | 10/1979 | Carrier | 225/43 |
| 4,204,618 | 5/1980 | Reed et al. | 225/52 |
| 4,384,664 | 5/1983 | Rous | 225/52 |
| 4,787,543 | 11/1988 | Fabo et al. | 225/52 |
| 4,881,675 | 11/1989 | Varley | 225/52 |
| 4,882,175 | 11/1989 | Ream et al. | 426/5 |

FOREIGN PATENT DOCUMENTS

| | | | |
|---|---|---|---|
| 230852 | 11/1958 | Australia | 225/43 |
| 1145644 | 3/1956 | France | 225/47 |
| 10614 | 5/1897 | United Kingdom | 225/43 |
| 398088 | 9/1933 | United Kingdom | 225/52 |
| 944260 | 12/1963 | United Kingdom | 225/43 |
| 1256441 | 12/1971 | United Kingdom | 83/649 |

*Primary Examiner*—Steven Weinstein
*Attorney, Agent, or Firm*—Willian Brinks Olds Hofer Gilson & Lione

[57] ABSTRACT

There is disclosed a package and dispenser for a rolled, tape-like confectionery product. This dispenser includes a housing means which has top, bottom and side wall means. There is an opening in the side wall means adapted to allow an end of the confectionery product to pass through. The dispenser also includes a hinged means with a hinged end located on one side of the opening. Cutting means are provided on the other side of the opening for contacting and cutting the confectionery product. Locking means are also provided for locking the hinged means in a closed position covering the opening.

6 Claims, 4 Drawing Sheets

FIG. 8
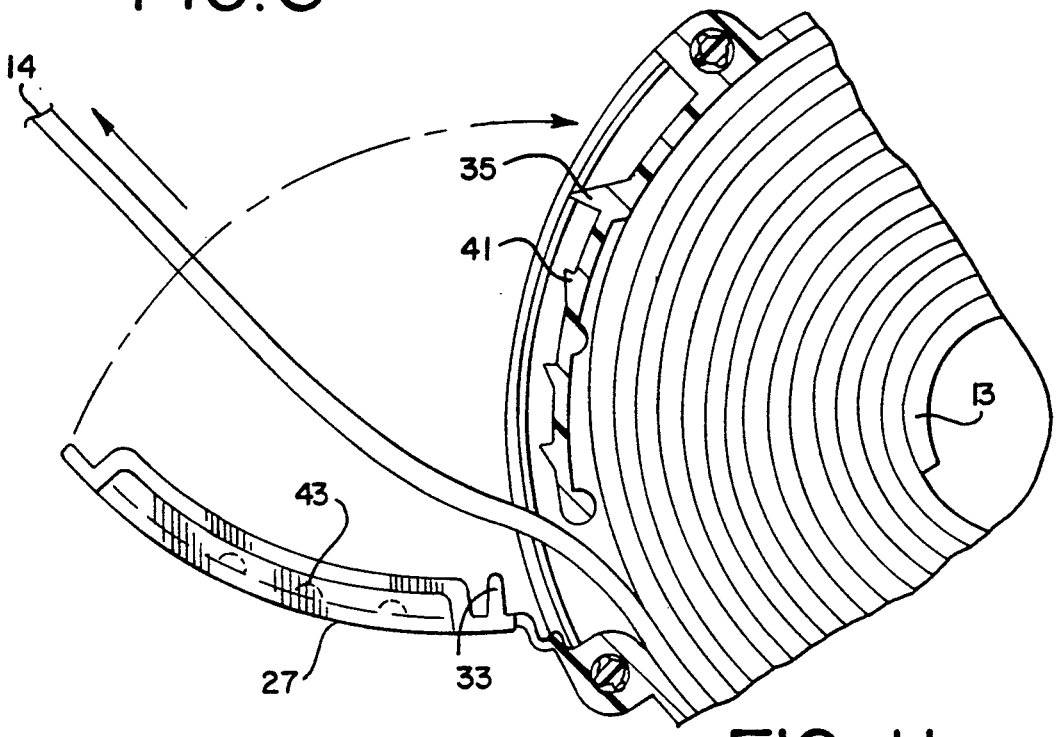
FIG. 11
FIG. 9
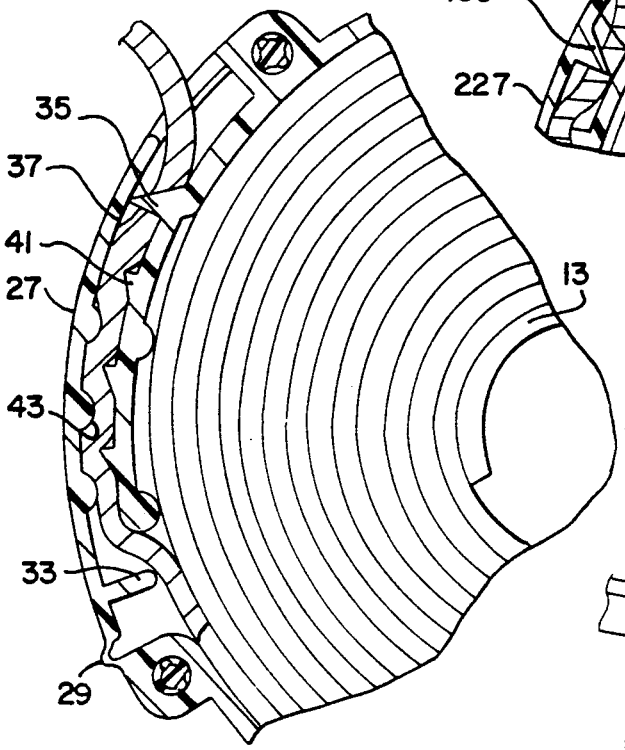
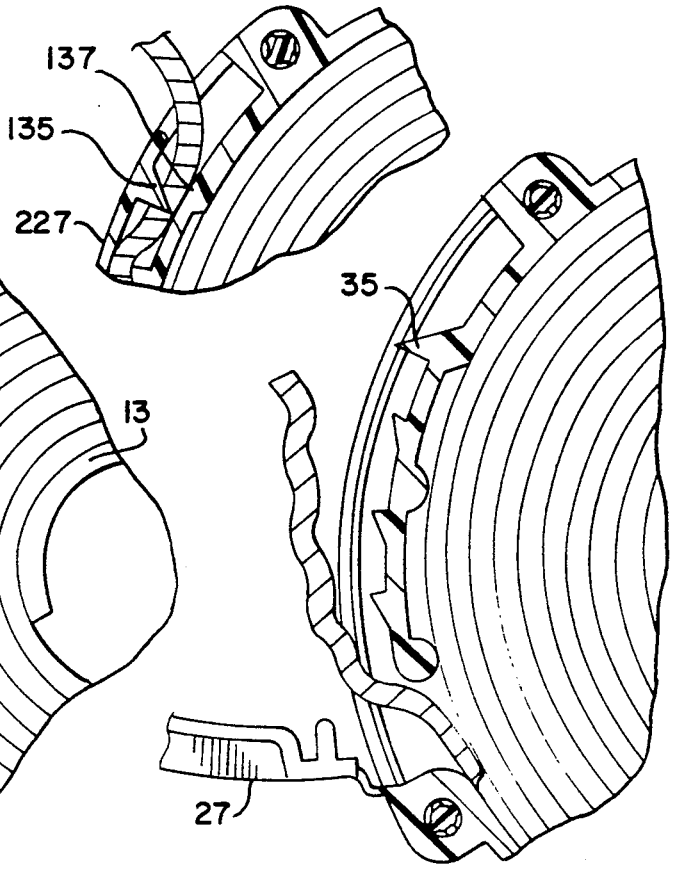
FIG. 10

ROLLED TAPE-LIKE CONFECTIONERY PRODUCT IN A DISPENSER

BACKGROUND OF THE INVENTION

The present invention relates to the field of packages which also serve as dispensers for food products. More particularly, the invention relates to a package and dispenser for a rolled confectionery product. For convenience, the term dispenser, as used in the specification and appended claims, will refer to a product which is both a package and a dispenser.

Confectionery products, such as chewing gum, have been molded, extruded or otherwise shaped into various forms over the years. It is generally known that providing confectionery products, such as bubble gum, in novelty shapes or forms can lead to enhanced marketability of such a product, particularly with younger consumers.

U.S. Pat. No. 4,882,175, assigned to the same assignee as the present application, discloses a method and apparatus for forming a confectionery product into a rolled tape. The assignee of the present invention has marketed such a product under the trademark "Bubble Tape." In particular, the product consists of six feet of chewing gum rolled up and packaged in a relatively flat cylindrical cup, such as that shown in FIG. 8 of the '175 patent.

Although mention was made in the specification of the '175 patent of using "a more sophisticated plastic dispenser" (Col. 6, lines 7–8), no design for such a dispenser was shown.

SUMMARY OF THE INVENTION

Briefly stated, the present invention is a package and dispenser for a rolled, tape-like confectionery product. The dispenser includes a housing means which has top, bottom and side wall means. There is an opening in the side wall means adapted to allow an end of the confectionery product to pass through. The dispenser also includes a hinged means with a hinged end located on one side of the opening. Cutting means are provided on the other side of the opening for contacting and cutting the confectionery product. Locking means are also provided for locking the hinged means in a closed position covering the opening.

In accordance with a preferred embodiment, the top and bottom walls are circular and the side wall is cylindrical. Also, the cutting means is preferably formed by a knife edge on the side wall and an anvil surface on the hinged means.

The present invention offers the advantage of providing a novel package and dispenser for a confectionery product which is itself in a relatively novel form, i.e. a rolled up tape. The novelty of the dispenser adds to the novelty of the total product, and thus can enhance its marketability, particularly with younger consumers.

The present invention is also advantageous in that the hinged member serves the two functions of cutting segments of the confectionery product, and of closing the dispenser when not in use.

The present invention, together with attendant objects and advantages, will be best understood with reference to the detailed description below read in conjunction with the accompanying drawings.

BRIEF DESCRIPTION OF THE DRAWINGS

FIGS. 8–10 are cross-sectional views showing the operation of the preferred embodiment.

FIG. 11 is a cross-sectional view showing an alternative embodiment.

DETAILED DESCRIPTION OF THE PREFERRED EMBODIMENTS

Figure 1:
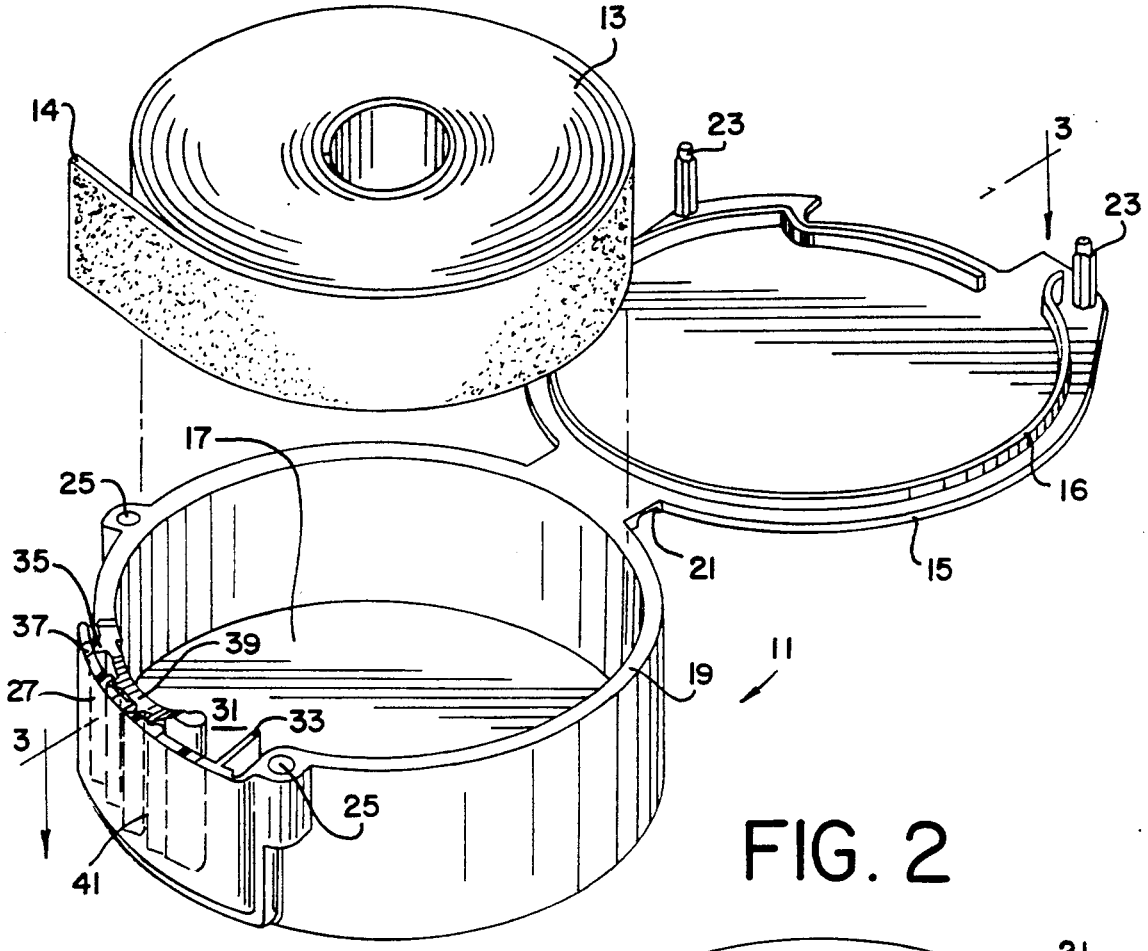
FIG. 1 is a perspective view of the preferred embodiment of the present invention with the lid open.
Figure 2:
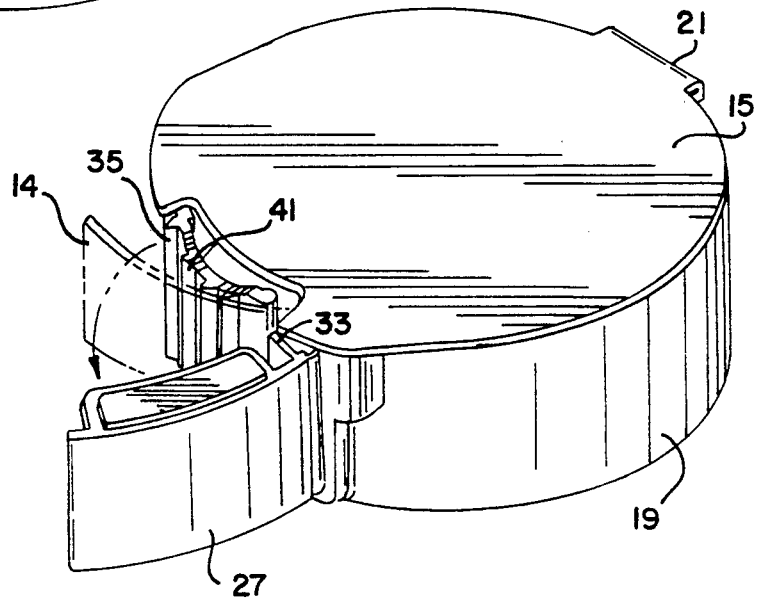
FIG. 2 is a view similar to FIG. 1 with the lid closed.

Referring to the drawings, FIG. 1 is a perspective view showing the most preferred package and dispenser 11 for the rolled confectionery product 13. As noted above, the term dispenser will refer to this item which is both a package and a dispenser. Most preferably, the dispenser will contain a six foot roll of chewing gum. Alternatively, other confectionery products, such as taffy, caramel, or chewing candy can be used so long as they are provided in the form of a rolled tape.

Preferably, the dispenser will be sold with the confectionery product inside and thus will be considered a disposable package. Alternatively, the dispenser can be sold separately and/or be re-used by the consumer. Preferably, the dispenser will be injection molded from an inexpensive plastic such as polypropylene. Most preferably, the container walls will be about 0.040" thick.

The dispenser 11 includes a housing which has a top 15, a bottom 17, and a side wall 19. In this preferred embodiment, the housing is in the form of a cylindrical can. In particular, the top and bottom are generally circular, and the side wall is cylindrical. Other shapes of housing may also be employed. For example, the tops and bottom can be in the shaped of a triangle, square, pentagon, hexagon, etc. However, because the confectionery product is in the form of a rolled tape, i.e. circular, the cylindrical shape for the housing is preferred over these other shapes.

As can be seen, the preferred side wall 19 is in the form of a single wall with a substantially uniform thickness. As a result, the inside shape of the side wall is similar to the outside shape. In alternative embodiments, the side wall can have a varying thickness so that, for example, the housing can have a cylindrical shaped cavity and have a different shaped outside. In other alternative embodiments, the side wall can be formed of two walls to achieve the same effect, i.e. an outside with a different shape than the cavity within. Nevertheless, because the dispenser is preferably a disposable package, and because confectionery products are typically low cost items, it is preferred to make the dispenser as inexpensively as possible. Thus, a single wall side wall with a generally uniform thickness is preferred.

Figure 4:
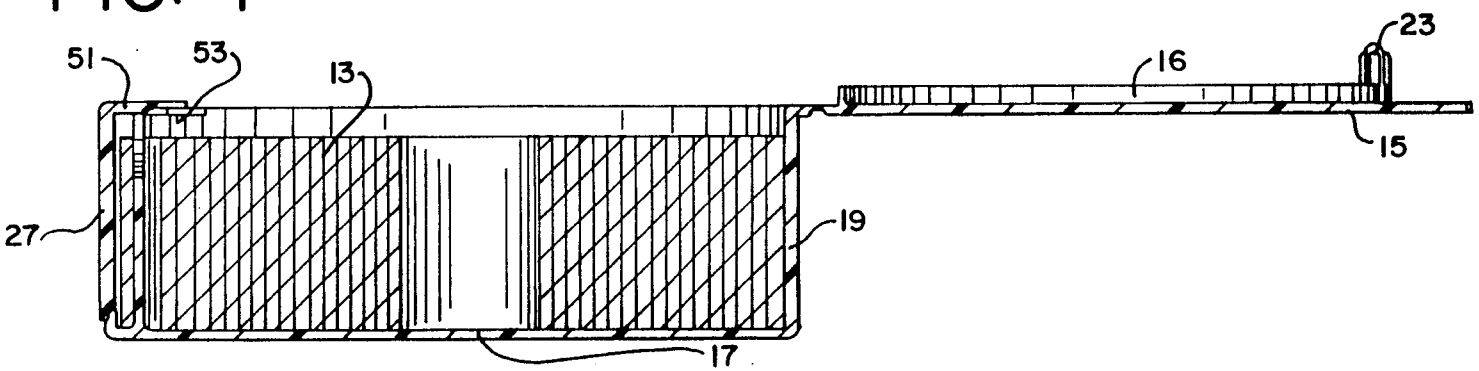
FIG. 4 is a cross-sectional view taken along line 4—4 of FIG. 3.
Figure 4A:
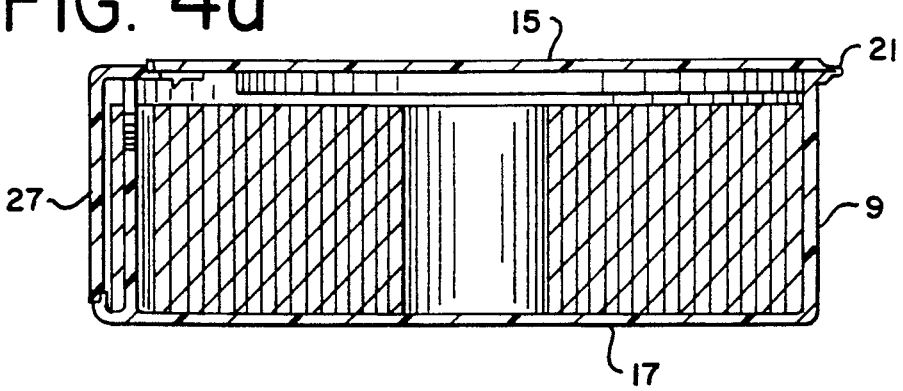
FIG. 4*a* is a cross-sectional view similar to FIG. 4 with the lid closed.
Figure 6:
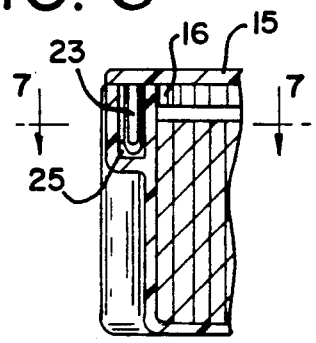
FIG. 6 is a cross-sectional view taken along line 6—6 of FIG. 3.
Figure 7:
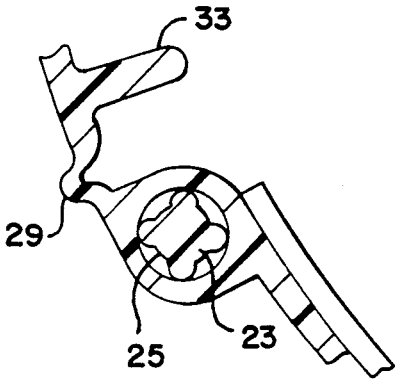
FIG. 7 is a cross-sectional view taken along line 7—7 of FIG. 6.

Referring also to FIGS. 4 and 4a, the top 15 includes a ridge 16 which fits inside the side wall 19. Referring also to FIGS. 6 and 7, the top also includes prongs 23 which are interference fit into cavities 25 on the side wall. The ridge 16 and the prongs 23 give a secure closure.

Figure 12:
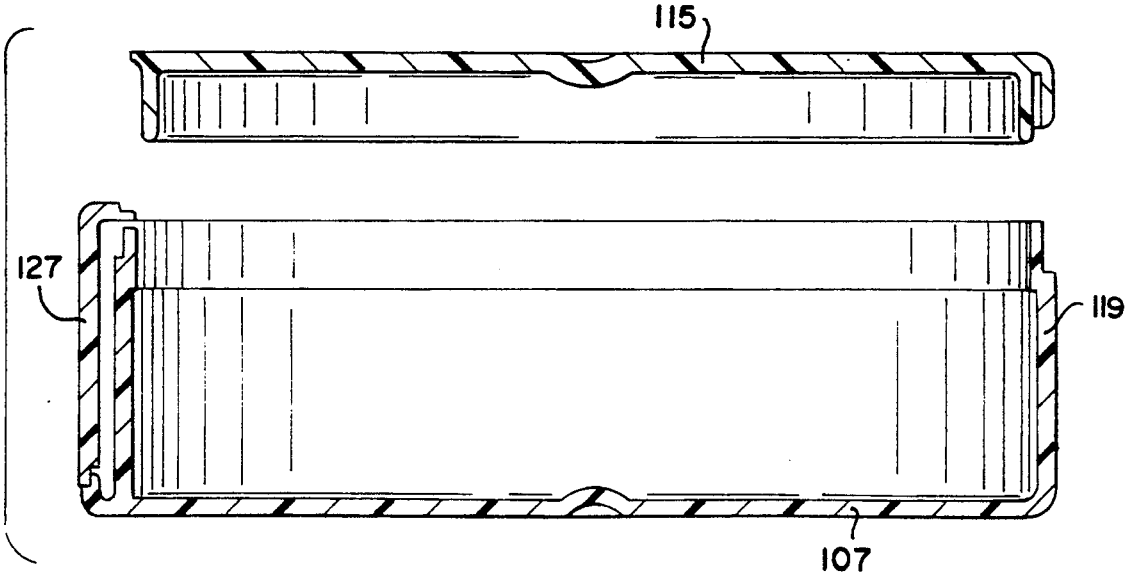
FIG. 12 is a cross-sectional view showing another alternative embodiment.

In the most preferred embodiment, the top 15 is connected to the side wall 19 through a hinge 21. In this way, the dispenser can be made in a single piece, thus reducing the cost of producing the dispenser. Alternatively, the top can be made as a separate piece, as shown in FIG. 12.

An opening 31 is formed in the side wall and is of sufficient dimensions to allow the leading edge 14 of the chewing gum 13 to pass therethrough with ease.

Referring also to FIGS. 2 and 8-10, it is seen that a hinged member 27 is connected to the side wall through the hinge 29 located on one side of the opening 31. Tab 33 operates to bend the gum as the hinged member 27 is closed. By making this bend in the gum, the gum is less likely to slide back within the housing. Ridges 41 are included for this same purpose, namely to prevent the gum from sliding back into the housing.

FIGS. 8-10 illustrate the cutting means of this preferred embodiment. As can be seen, the means for cutting the confectionery product is provided in the form of a knife edge 35 on the side wall a certain distance from the opening 31. There is also provided an anvil surface 37 on the hinged member 27. As a result, a segment of the confectionery product can be cut by first opening the hinged member, i.e. swinging it away from the side wall. Next, the desired length of product is pulled past the knife edge 35. The hinged member is then closed, i.e. swung toward the side wall until the gum is severed, or is at least scored sufficiently to allow the consumer to pull of the piece easily.

As best seen in FIGS. 8-10, the side wall on the other side of the opening 31 preferably includes a series of ridges 41 and the hinged member includes a series of ridges 43 which cooperate to grip the chewing gum when the hinged member is in the cutting and closed position.

The dispenser also includes means for locking the hinged member in the closed position, i.e. against the side wall. As mentioned above, it is advantageous that the hinged member, not only facilitates cutting of the confectionery product, but also is used to cover the opening and thus close the dispenser when not in use.

Figure 5:
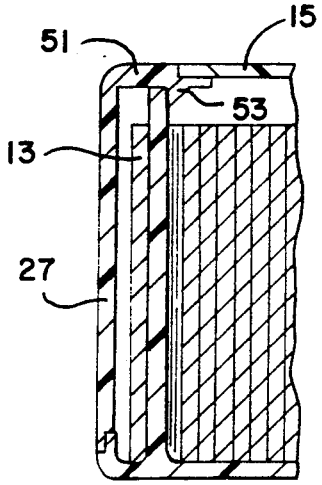
FIG. 5 is a cross-sectional view taken along line 5—5 of FIG. 3.
Figure 3:
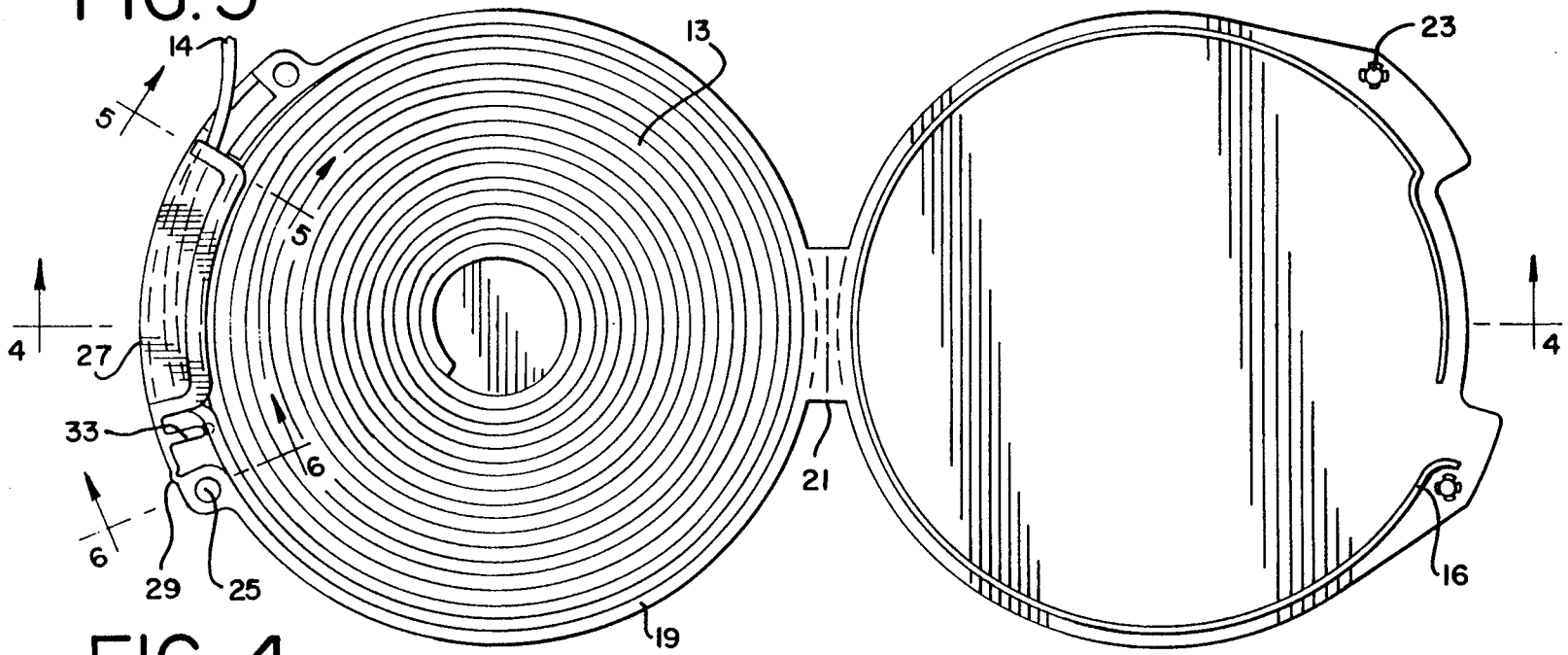
FIG. 3 is a top view of the embodiment of FIG. 1 with the lid open.

As seen in FIG. 5, the locking means of this most preferred embodiment comprises a tab 51 on the hinged member. The tab 51 is located at the top of the hinged member and extends toward the side wall. The tab includes a ridge 53 which is configured so as to slide up and over the top edge of the side wall and thus secure the hinged member in the closed position. Because the material of which this embodiment is made is relatively flexible, the hinged member can be released by simply pulling it away from the side wall.

FIG. 11 shows an alternative embodiment wherein the knife edge 135 is located on the hinged member 227 and the anvil surface 137 is located on the sidewall.

FIG. 12 show another alternative embodiment wherein the lid 115 is made as a separate piece from the rest of the housing.

It should be noted that although much of the discussion has involved cylindrical dispenser, other shapes are also within the invention. Also, it is noted that confectionery products other than chewing gum can be packaged in and dispensed from the dispenser of the present invention. Certainly, these and all other modifications which are within the ordinary skill in the art to make are considered to lie within the scope of the invention as defined by the appended claims.

We claim:

1. A package and dispenser with a rolled, tape-shaped length of chewing gum housed therein comprising:

a housing having a top, bottom and side wall forming a chamber;

a rolled, tape-shaped length of chewing gum within the chamber;

an opening in the side wall of said housing sufficient to allow a free end of said chewing gum to pass therethrough;

a hinged member having one end hinged to the side wall on one side of said opening and comprising a cover portion between said one end and the opposite end of said hinged member;

a cutter either being part of said hinged member at the end of said hinged member opposite said one end or being part of said side wall on the side of said opening opposite from said one side of said opening;

said cover portion of said hinged member covering said opening in said side wall and a length of said side wall between said opening and said cutter when said hinged member is in a closed position to thus close the opening and enclose said gum;

said cutter on either said hinged member or said side wall comprising a knife edge which co-acts with an opposing anvil surface on either said side wall or said hinged member respectively, such that when said free end of said tape-shaped length of chewing gum is pulled through said opening to expose a desired length and said hinged member is pressed down against said chewing gum and said side wall, said knife edge and said anvil cooperate to either sever said gum or at least sever said gum sufficient to allow a consumer to easily pull off a piece of gum from said exposed length;

said length of said side wall and said cover portion each further comprising a series of corresponding ridges such that when said hinged member is in the cutting and closed position, said ridges cooperate to grip said chewing gum sufficient to at least slightly deform a length of said uncut chewing gum that projects outwardly of said opening so as to retain said length of chewing gum between said corresponding opposing ridges thereby preventing the length of chewing gum from passing back into said housing.

2. The package of claim 1 further comprising means for locking the hinged member in a closed position, said locking means comprising a flange on the hinged member cooperating with a groove on the sidewall.

3. The package of claim 1 further comprising means for locking the hinged member in a closed position, said locking means comprising a tab on the hinged member which extends toward the sidewall, said tab including a ridge which ridge is adapted to slide up and over an edge of the sidewall.

4. The package of claim 1 wherein the hinged member further comprises a tab which projects through the opening when the hinged member is in the closed position to thereby deform the chewing gum and further prevent the end of the chewing gum from passing back into the chamber.

5. The package of claim 1 wherein the chamber does not include a spindle about which the rolled, tape-shaped length of chewing gum is wound.

6. The package of claim 1 wherein the chewing gum is bubble gum.

* * * * *